United States Patent [19]

Betschart

[11] Patent Number: 4,483,118

[45] Date of Patent: Nov. 20, 1984

[54] SUPPORT SYSTEM FOR BUILDING CONSTRUCTION

[76] Inventor: Anton-Peter Betschart, Tuchmachergasse 3a, D-7000 Stuttgart 50, Fed. Rep. of Germany

[21] Appl. No.: 224,677

[22] Filed: Jan. 13, 1981

[30] Foreign Application Priority Data

Jan. 16, 1980 [DE] Fed. Rep. of Germany ..... 3001309

[51] Int. Cl.[3] ..... E04C 3/02

[52] U.S. Cl. ..... 52/648; 52/694; 403/171; 403/176

[58] Field of Search ..... 52/648, 646, 637, 693, 52/694, 84; 403/171, 176, 174, 178, 173, 170

[56] References Cited

U.S. PATENT DOCUMENTS

| | | | |
|---|---|---|---|
| 1,483,602 | 2/1924 | Bloss et al. | 403/174 |
| 2,308,565 | 1/1943 | Mitchell | 52/648 |
| 2,840,014 | 6/1958 | Wadsworth et al. | 52/639 |
| 3,104,454 | 9/1963 | Handley et al. | 52/648 |
| 3,394,419 | 7/1968 | Sedlacek | 52/646 |
| 3,507,526 | 4/1970 | Packman et al. | 403/174 |
| 3,902,289 | 9/1975 | Dashew | 52/648 |
| 3,914,063 | 10/1975 | Papayoti | 52/648 |
| 3,948,012 | 4/1976 | Papayoti | 52/648 |
| 3,999,351 | 12/1976 | Rensch | 52/648 |
| 4,069,832 | 1/1978 | Bingham | 52/648 |
| 4,098,045 | 7/1978 | Astor | 52/648 |
| 4,122,646 | 10/1978 | Sapp | 403/171 |

FOREIGN PATENT DOCUMENTS

| | | | |
|---|---|---|---|
| 19661 | 12/1914 | Denmark | 403/173 |

*Primary Examiner*—John E. Murtagh
*Assistant Examiner*—Michael Safavi
*Attorney, Agent, or Firm*—Peter K. Kontler

[57] ABSTRACT

The invention relates to a support system for buildings having straight, longitudinally and transversely extending girders which are subjected to both compressive and tensional stresses. The girders are releasably connected to one another by connecting members. The girders and the connecting members are each in the form of a single casting made of a ductile metallic material such as gray cast iron with spheroidal graphite, malleable cast iron or cast steel.

37 Claims, 8 Drawing Figures

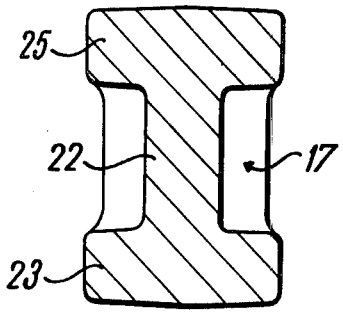
Fig.6
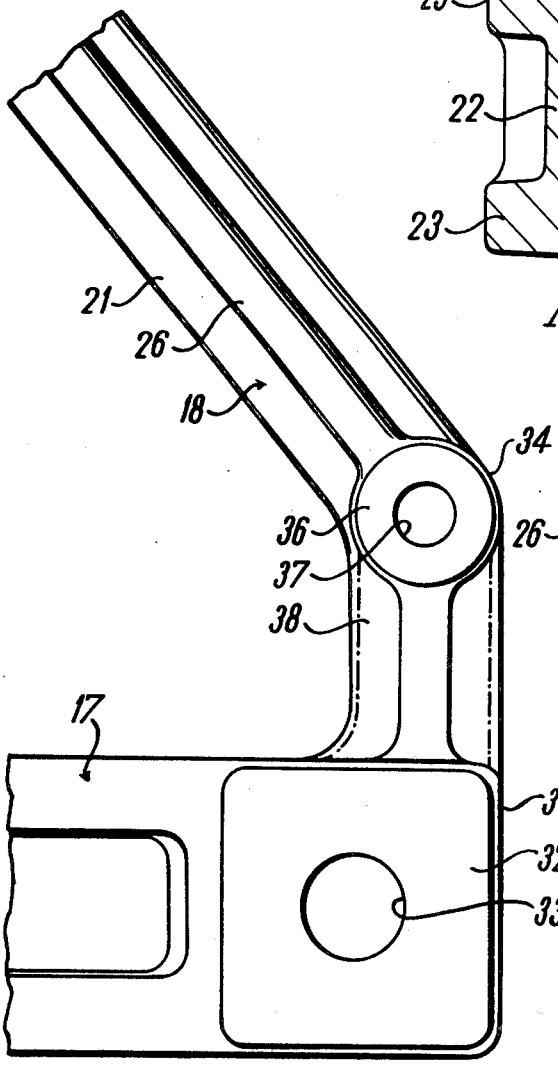
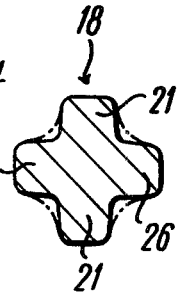
Fig.5
Fig.7

SUPPORT SYSTEM FOR BUILDING CONSTRUCTION

BACKGROUND OF THE INVENTION

The present invention relates to a support system for buildings.

Such a support system is known from German Published Application No. 26 00 602. In this system, the girders are welded together from several commercially available hollow, metallic shapes and the connecting members are likewise welded designs. A drawback of this is the substantial expenditure of time and material during manufacture. Although commercial shapes and strips can be used, these must be cut to proper length and then welded together with substantial expenditures in time. The connecting members in particular are extremely complicated under certain circumstances.

OBJECTS AND SUMMARY OF THE INVENTION

It is therefore an object of the present invention to provide a support system for buildings which can be produced at relatively low cost and which is readily adaptable even to complicated force systems.

In accordance with the invention, this object is achieved by a support system for structures or buildings in which each of a plurality of structural members or girders subjected to tensile and compressive loading simultaneously, as well as each of a plurality of connecting members or junction elements, is constituted by a single casting of a ductile metallic material.

Thus, according to the present invention, the known welded construction of the support system is completely replaced by a cast construction. This exhibits a number of advantages, particularly in that the individual girders and connecting members may assume complicated shapes which conform to the force system, i.e. different wall thicknesses, additional reinforcing ribs and the like can be provided in a simple manner. The optimum dimensioning which may thus be achieved for the particular force system allows savings in weight and material to be realized. Additional advantages arise in manufacture since casting is the only method by which one can proceed directly from the starting material to the final product. Furthermore, by using a cast, ductile metallic material, the girders can be subjected not only to compressive stresses, as was heretofore the case with gray cast iron members, but they can also be subjected to tensional stresses. Suitable cast, ductile materials are malleable cast iron and cast steel. However, gray cast iron with spheroidal graphite is preferable and, by way of example, a preferred embodiment of the invention uses GGG 40.

Within a girder, diagonal rods or reinforcing members may be arranged between lower and upper beams in such a way that their imaginary extensions meet at the longitudinally extending neutral axes of the lower and upper beams. Ribs which form extensions of the diagonal rods may be provided and continue at least to the neutral lines of the upper and lower beams where they merge. In this type of design, it is advantageous for the lower and/or upper beams to have I-shaped cross-sections and for the diagonal rods to have cruciform cross-sections.

According to a preferred embodiment of the present invention, the ends of the beams, and especially of the upper beams which are subjected to compressive stresses, are relatively slender whereas the widths of their central regions gradually increase in relation to stress. Such widening serves primarily to take up the higher buckling stresses in the longitudinal center of the girder. Depending upon the compressive stresses, the cross-sectional area may remain constant as the width increases or may increase accordingly. Thus, the dimensioning can be adapted to different loads with little or no variation in geometry. In any event, it is advantageous in this embodiment for the connecting members to be relatively small or narrow.

The connecting members may also be readily formed in comformance with the expected stresses. In a preferred embodiment of the present invention, the connecting members have a cruciform shape and are provided with mutually opposite pairs of flanges which accommodate the ends of the lower or upper beams and, where appropriate, of the corresponding diagonal rods. For example, a pair of flanges of a connecting member may embrace the end of a lower beam and the overlying end of a corresponding diagonal rod. The flanges which accommodate the ends of both a beam and a diagonal rod extend transversely to a central or symmetry plane of the corresponding connecting member and are so arranged with reference to this plane that the neutral axes of the beam, e.g., a lower beam, and the diagonal rod intersect one another in this central plane. This ensures in a simple manner that no shifting moments arise at the connecting member. Securing of the ends of the girder to the connecting member is effected by connecting bolts which enter into registering transverse bores. Bosses are provided in the regions of the bores and, prior to machining of the castings, are of sufficient thickness to compensate for tolerances and to render it possible to machine flat the abutting surfaces of bosses on the respective elements. The bores in a beam and a diagonal rod which are to be secured to the same pair of flanges of a connecting member, as well as the corresponding bores in the flanges, may be positioned with reference to each other in such a way that the girders are horizontal. However, it is also possible to arrange these bores with reference to each other in such a way that the girders, which preferably constitute a carrier grid arrangement, make a small acute angle with the horizontal so that, over a length of several grids and connecting members, one obtains a polygonal arc which compensates for sagging of the support system under load. It is to be understood that, in this manner, it is also possible to achieve intentional polygonal arcs which go beyond the extent of actual sagging.

The present invention further relates to the use of cast, ductile metallic material, e.g., malleable cast iron, cast steel and, preferably, gray cast iron with spheriodal graphite, for all components of a support system for structures or buildings. The invention is particularly concerned with support systems of the type having longitudinally and/or transversely extending planar girders which respectively include an upper beam, a lower beam and diagonal rods and which are releasably connected to one another by connecting members.

Brittle gray cast iron was used in the last century as a material for structures such as bridges, buildings and the like, but only for parts which were subjected to compressive stresses so that these structures resembled stone structures. After the middle of the last century, rolling of sheet metal and bars became known. This rendered it possible to make steel shapes of different cross-sectional configurations in great lengths. The advantageous strength characteristics of rolled steel which, due to its great toughness, and as opposed to brittle cast iron, can be subjected to tensional, bending and compressive stresses, permitted rolled steel to replace cast iron in building construction. This is attributable not only to the development of rolled steel, which is the predecessor of todays structural steel, but also to the pronounced drawbacks of early cast iron which, due to its high carbon content, was brittle and therefore offered little resistance to tensional and bending stresses. While the use of steel in building construction expanded due to continuous further development of structural steel, as well as processing and connecting techniques therefor, the use of cast iron in building construction virtually ceased. Thus, only limited applications remained for cast iron in building construction, e.g., water pipes, radiators and sanitary articles and fittings. However, further development of casting techniques took place in the machinery and vehicle industries. A large number of new ferrous and light-metal casting materials having a wide variety of properties were developed together with suitable forming and casting methods. Many of these casting materials exhibit excellent strength and good shaping characteristics so that one can produce cast parts which can simultaneously withstand high tensile, bending and compressive stresses. Although intended for other applications, these newly developed casting materials, contrary to early cast iron, meet the static requirements of modern building construction. This creates the possibility of utilizing the superior structural and shaping characteristics of cast, ductile metallic materials in building construction in an inventive manner.

Further details and embodiments of the invention can be found in the following description wherein the invention is described more fully with reference to the accompanying drawing.

BRIEF DESCRIPTION OF THE DRAWING

FIG. 5 is a section along the line V—V of FIG. 1, FIG. 6 is a section along the line VI—VI of FIG. 1, FIG. 7 is an enlarged view of the area within the circle VII of FIG. 1.

DESCRIPTION OF THE PREFERRED EMBODIMENTS

Figure 1:
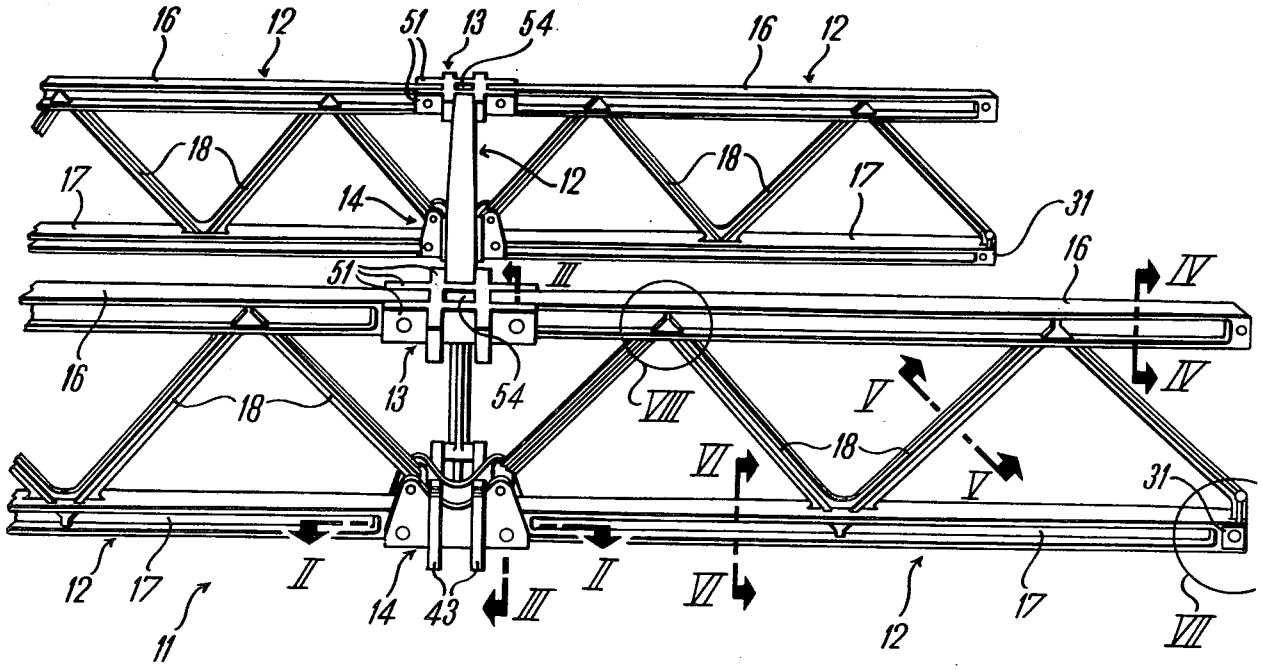
FIG. 1 is a schematic perspective representation of a portion of a grid-like support system in accordance with the present invention.

In the preferred embodiment of FIG. 1, the novel support system for structures or buildings includes a carrier grid arrangement 11 having identical longitudinally and transversely extending girders or structural members 12 which are connected to each other by upper and lower junction elements or connecting members 13 and 14. The entire carrier grid arrangement 11, i.e., the girders 12 as well as the junction elements 13, 14, is made of a cast, ductile metallic material. This material may, for example, be malleable cast iron, cast steel or cast aluminum. However, gray cast iron with spheroidal graphite is preferred and tests have been carried out on a carrier grid arrangement made of GGG 40. Each girder 12 and each of the junction elements 13 and 14 is a one-piece element cast from a ductile metallic material and these elements, which are provided with a slope (here 2°) as is customary in casting, can be subjected to tensile as well as compressive stresses.

Ductile materials must readily satisfy static requirements since they are tough, extensible, plastically deformable and resistant to impact stresses. To ensure the presence of such characteristics in ferrous materials, these must exhibit a predominantly ferritic microstructure. Best suited for highly stressed components in buildings are ferritic, annealed cast iron with spheroidal graphite (GGG) in accordance with DIN norm 1693; cast, ferritic steels (GS) according to DIN norm 1681, DIN norm 17245 and St-E-W 680, St-E-W 510 and St-E-W 410 (Stahl-Eisen-Werkstoffblatt); and decarburized, annealed, malleable cast iron (GTW) according to DIN norm 1692. The ductility of such cast materials is attributable to alloying, special handling of the melt and controlled heat treatment which are the results of scientific experiments of the last two decades. For structures which are subjected exclusively to compressive stresses, cast iron with lamellar graphite, which is known simply as gray cast iron (GG), continues to be the most suitable material. Its high compressive strength, resistance to corrosion, minimal shrinkage and especially its highly satisfactory castability are superior to those of any other iron-carbon casting alloy. Furthermore, owing to the aforementioned characteristics, products of gray cast iron can be made at a very low cost. While it is true that the strength characteristics of steel castings come closest to those of structural steel, such castings are very expensive to produce because of the high volumetric contraction and low carbon content which make them very susceptible to shrinkage. The resulting strong tendency to piping necessitates very costly measures for tight feeding of molten metal to the mold so as to avoid piping.

Figure 8:
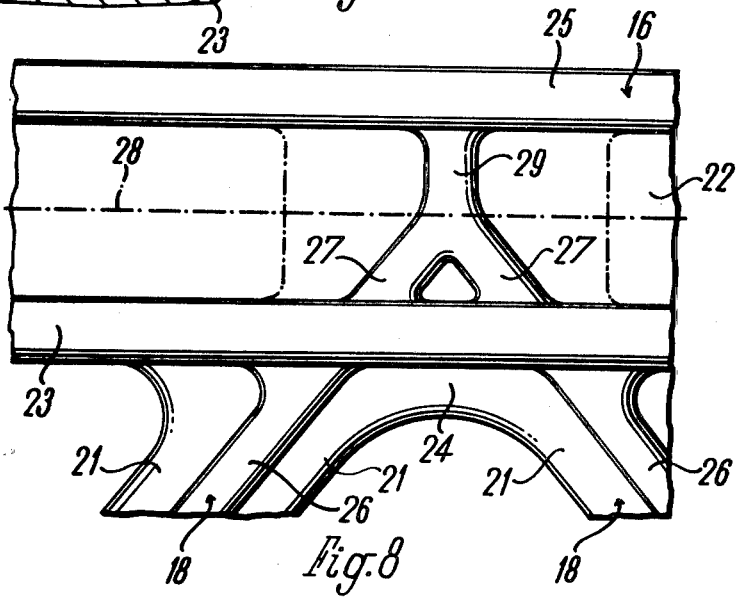
FIG. 8 is an enlarged view of the area within the circle VIII of FIG. 1.

Each girder 12 is composed of an upper beam 16, a lower beam 17 and inclined diagonal rods or reinforcing beams 18 extending therebetween. In this embodiment, the girder 12 has four diagonal rods 18 which are inclined at an angle of about 45° relative to the upper and lower beams 16, 17. The outermost ones of the diagonal rods 18 terminate at the ends of the girder 12 in the region of the lower beam 17 and the ends of pairs of neighboring diagonal rods 18 are located adjacent one another at the upper and lower beams 16, 17. As shown in FIG. 5, the diagonal rods 18 are substantially cruciform in cross-section while, as seen in FIG. 6, the upper and lower beams 16, 17 are of I-shaped cross-section. The maximum width of the cruciform diagonal rods 18 is less than that of the upper and lower beams 16, 17. As can be seen in FIG. 8, a one-piece cast connection exists between two neighboring diagonal rods 18 as well as between the diagonal rods 18 and the upper and lower beams 16, 17. The connections are such that one of the webs 21 (FIG. 5) which forms part of each cruciform diagonal rod 18 extends in the direction of the connecting webs 22 (FIGS. 4 and 6) of the corresponding upper and lower beams 16, 17. Furthermore, these webs 21 join the neighboring transverse webs or flanges 23 and 25 (FIGS. 4 and 6) of the corresponding upper and lower beams 16, 17 at the longitudinal center lines of the latter from below or above so that the connecting webs 22 in effect constitute continuations of the respective webs 21. The webs 21 of two neighboring diagonal rods 18 are connected with one another by an arcuate rib 24 (FIG. 8) located at the lower or upper side of the corresponding beam 16, 17. The webs 26 (FIG. 5) of the cruciform diagonal rods 18, which extend at right angles to the webs 21, also merge into the underside or upper side of the respective beams 16, 17. The webs 26 have extensions in the form of ribs 27 (FIG. 8) provided on the connecting webs 22 of the beams 16, 17. The ribs 27 forming extensions of two neighboring webs 26 merge at the symmetry line or neutral axis 28 of the corresponding beam 16, 17 and then continue as a common rib 29. The rib 29 is perpendicular to the transverse webs 23, 25 of the corresponding beam 16, 17 and extends all the way to the underside or upper side of the transverse web 23 or 25 opposite that from which the ribs 27 radiate. In this manner, neighboring diagonal rods 18 merge with one another at the symmetry line or neutral axis 28 of the corresponding upper beam 16 or lower beam 17. Stated in another way, imaginary extensions of neighboring diagonal rods 18 meet at the neutral axis 28 of the corresponding upper beam 16 or lower beam 17. For reasons related to the achievement of better tight feeding, the ribs 27, 29 may form an invisible part of the cross-section which, in the region of a beam 16 or 17 corresponding to the ribs 27, 29, is square or rectangular as shown in FIG. 8 by phantom lines.

Figure 4:
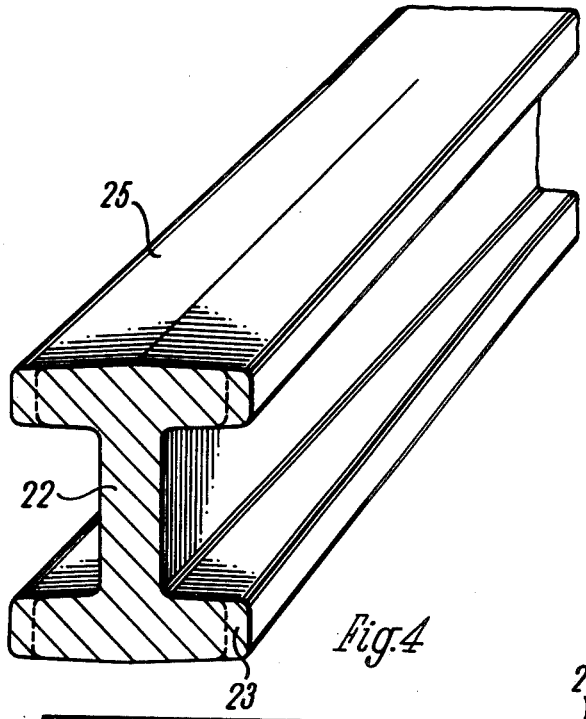
FIG. 4 is a section along the line IV—IV of FIG. 1 on an enlarged scale.

As can be seen in FIG. 4, the cross-sections of the upper beams 16, and also of the lower bams 17, can conform to the stress distribution, i.e., to the fact that the stresses which arise in the central region of the girder 12 are greater than those at the ends thereof. Thus, the widths of the transverse webs 23, 25 of the beams 16, 17 continously increase from the ends to the central regions thereof so that the cross-sectional areas in the central regions are increased and the beams 16, 17 thus have a greater ability to withstand stresses. This further enables the ends of the beams 16, 17 to remain slender or narrow which, among other things, has a beneficial effect upon the shape of the junction elements 13, 14. It is also possible to widen the transverse webs 23, 25 while reducing the thickness of selected portions of the beams 16, 17 if the compressive stress along the length of the girder 12 is to remain constant but the buckling load in the central region is to be higher than at the ends. In this case, the cross-sectional areas of the beams 16, 17 longitudinally thereof may remain constant.

Figure 2:
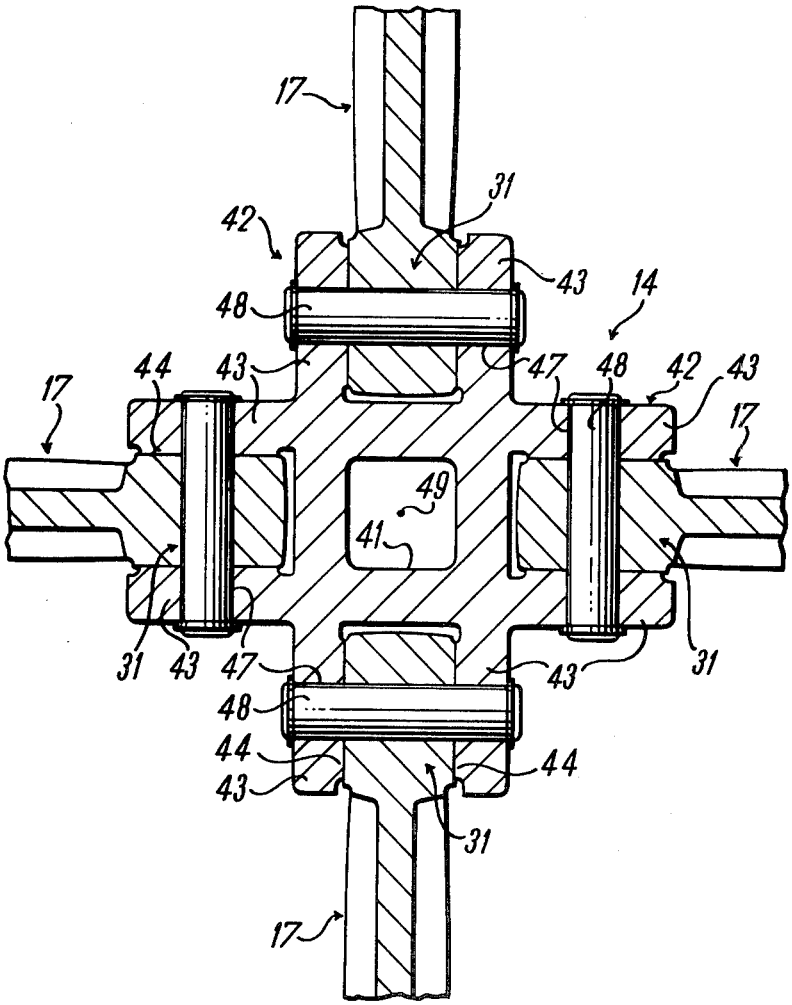
FIG. 2 is a section along the line II—II of FIG. 1 on an enlarged scale.
Figure 3:
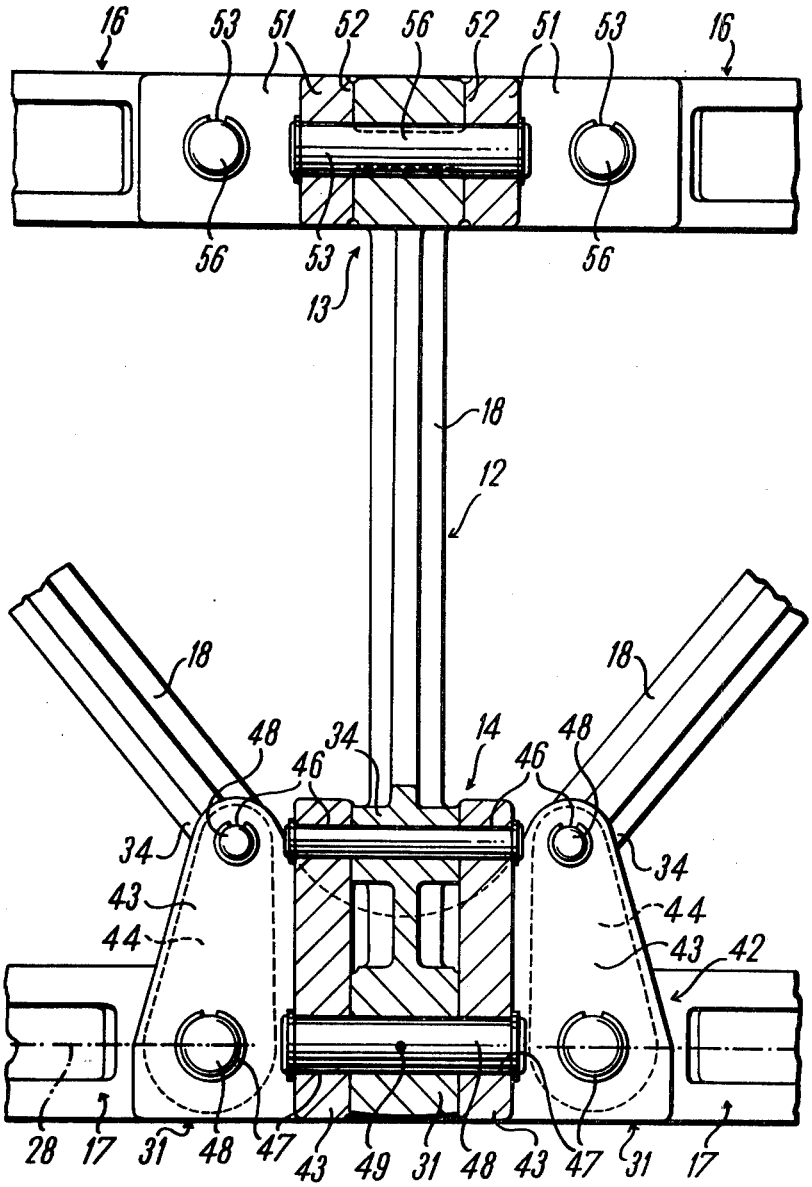
FIG. 3 is a section along the line III—III of FIG. 1 on an enlarged scale.

The ends 31 of the upper beams 16 and lower beams 17 are rectangular as shown in FIGS. 2 and 3. The ends 31 are provided at both sides with integral bosses 32 (FIG. 7) which are traversed by transverse mounting bores or passages 33. Those ends 34 of the two outer diagonal rods 18 of each girder 12 which are remote from the neighboring diagonal rod 18 also have a rectangular cross-section (FIG. 3) but are circular in a side elevational view. Both sides of the ends 34 again have bosses 36 (FIG. 7) which are traversed by transverse mounting bores or passages 37. As shown in FIG. 7, the ends 34 of the outer diagonal rods 18 are located at a distance above the ends 31 of the lower beams 17 and are connected with the ends 31 by connecting parts or webs 38. The cruciform profiles of the ends 34 of the outer diagonal rods 18 are extended beyond the bosses 36 in such a way that the connecting parts 38 are normal to the respective lower beams 17. The respective bosses 32 and 36 of the lower beams 17 and diagonal rods 18 are not vertically aligned but are offset relative to each other. However, their outer edges register with one another. During casting, the bosses 32, 36, which are accommodated by the junction elements 13, 14, are made somewhat wider than necessary. This makes it possible to machine the outer or abutment surfaces of the bosses 32, 36 which face the junction elements 13, 14. For reasons related to tight feeding, the connecting part 38 preferably has a round or rectangular cross-section as shown by phantom lines in FIG. 7. For the same reasons, the regions of the ends 34 of the diagonal rods 18 may be provided with enlarged hollow flutings, as shown by phantom lines in FIG. 5, which gradually merge into the larger radii of the cross-sections of the diagonal rods 18.

As shown in FIGS. 1–3, the lower junction element 14 of the illustrated embodiment is of cruciform shape and has a rectangular receiving recess or opening 41 in its central region which, for example, may serve to receive a brace or the like. However, the central region of the junction element 14 may also be continuous. The junction element 14 has two pairs of diametrically opposite mounting arrangements 42. The mounting arrangements 42, which are offset relative to each other by 90°, are composed of two parallel cheeks or flanges 43. The sides of the cheeks 43 facing one other are provided with elongated protuberances or bosses 44 which have machined inner or abutment surfaces. The cheeks 43 have upper transverse mounting bores or openings 46 and lower transverse mounting bores or openings 47 which extend through the protuberances 44. As shown in FIG. 3, the lower regions of the cheeks 43 which receive the ends 31 of the lower beams 17 are wider than the upper regions which receive the ends 34 of the diagonal rods 18. The ends 31 and 34 of the beam 17 and rod 18 are connected with the lower junction element 14 by transverse bolts 48 which are held at both sides by safety rings. In the illustrated embodiment, the lower beams 17 extend in the horizontal direction while the diagonal rods 18 are arranged such that their imaginary extensions are directed towards the neutral axes 28 of the respective lower beams 17. The imaginary extensions meet at a point 49 of the respective junction element 14 which corresponds to the intersection of the neutral axes 28 of mutually normal lower beams 17 received by this junction element 14. In other words, the arrangement of the transverse bores 46 and 47 in the cheeks 43 relative to one another is the same as that of the transverse bores 33 and 37 in the ends 31 and 34 of the respective lower beams 17 and diagonal rods 18. It is also possible to select a relationship of the transverse bores 46 and 47 in the cheeks 43 such that the lower beams 17 enter the respective junction element 14 at a small acute angle to the horizontal. This results in a polygonal structure having a slight bulge, i.e., having an arc with a very large radius. The arc or bulge corresponds to a form of prestressing of the structure in that it may be selected in such a manner that the bending or flexing of the structure under load causes the lower beams 17 to assume essentially perfectly horizontal positions.

The upper junction element 13, which connects adjacent ends 31 of the upper beams 16, is constructed in a manner similar to that of the lower junction element 14 except that the cheeks or flanges 51 of the junction element 13 are provided with only one transverse mounting bore or opening 53 and that the protuberances or bosses 52 on the cheeks 51 are smaller than those of the junction element 14. Thus, the upper junction element 13 is also of cruciform shape and, like the junction element 14, may either have a continuous central region or may be provided with a rectangular receiving recess or opening 54 in this region for reception of a brace. The connection between the junction element 13 and the ends 31 of the upper beams 16 is effected by means of bolts 56 which are secured by rings, screws, rivets or the like.

Thus, in accordance with the invention, all of the girders 12 have the same length and height. Insofar as the cross-sections of the girders 12 are concerned, these may be identical or different, i.e., the girders 12 may be designed for different stresses. During casting of the girders 12, it is possible, for example, to form non-illustrated pins or lugs which project at right angles from the diagonal rods 18 to a location beyond the webs 26 and flank the webs 26 of a girder 12 below when the girders 12 are stacked. In this manner, the girders 12 can be stacked and at the same time protected against shifting. It is clear that the pins which prevent such shifting can also be arranged in the region of the upper and/or lower beams 16, 17.

I claim:

1. A support system for a structure such as a building, said system comprising:

(a) a plurality of structural members under tensile and/or compressive load, each of said structural members including an elongated first beam having a neutral axis, an elongated second beam spaced from the respective first beam and having a neutral axis, a plurality of inclined beams connecting the respective first and second beams and having respective neutral axes, and ribs on said elongated beams forming extensions of said inclined beams, and each of said structural members comprising at least one pair of neighboring inclined beams which converge in a direction towards a predetermined elongated beam of the respective structural member, the ribs which form extensions of neighboring converging inclined beams merging with one another substantially at the neutral axis of the respective predetermined elongated beam, and each of said structural members being constituted by a single casting of a ductile metallic material; and (b) connecting members connecting said structural members with one another.

2. A support system as defined in claim 1, wherein each of said connecting members is constituted by a single casting of a ductile metallic material.

3. A support system as defined in claim 1, wherein each of said structural members is under tensile and compressive loads simultaneously.

4. A support system as defined in claim 1, wherein said material is gray cast iron with spheroidal graphite.

5. A support system as defined in claim 1, wherein said connecting members releasably connect said structural members with one another.

6. A support system was defined in claim 1, wherein said structural members are substantially planar.

7. A support system as defined in claim 1, wherein at least some of said structural members are elongated in longitudinal direction of the structure.

8. A support system as defined in claim 1, wherein at least some of said structural members are elongated in transverse direction of the structure.

9. A support system as defined in claim 1, wherein said elongated beams are located at the upper and lower sides of the respective structural members.

10. A support system as defined in claim 1, wherein said inclined beams have cruciform cross-sections.

11. A support system as defined in claim 1, wherein said elongated beams have I-shaped cross-sections.

12. A support system as defined in claim 11, wherein each of said elongated beams comprises a pair of spaced flanges connected by a web and the widths of said flanges vary in longitudinal direction of the respective elongated beams.

13. A support system as defined in claim 1, wherein the widths of said elongated beams vary in longitudinal direction thereof.

14. A support system as defined in claim 13, wherein the cross-sectional areas of said elongated beams vary in relation to said widths.

15. A support system as defined in claim 13, wherein the cross-sectional areas of said elongated beams are substantially constant in longitudinal direction thereof.

16. A support system as defined in claim 1, wherein selected ones of said inclined beams have end portions in the regions of but spaced from the ends of selected ones of said elongated beams, each of said ends being connected with a respective one of said end portions by a web.

17. A support system as defined in claim 16, wherein said webs are substantially perpendicular to the respective elongated beams.

18. A support system as defined in claim 16, wherein each of said ends and each of said end portions has a boss on opposite sides thereof and a mounting passage extends between the respective bosses of each of said ends and each of said end portions.

19. A support system as defined in claim 1, wherein said elongated beams have ends and said connecting members include pairs of spaced flanges which respectively receive one of said ends.

20. A support system as defined in claim 19, wherein each of said pairs of flanges is provided with a set of mounting openings for the respective elongated beam.

21. A support system as defined in claim 19, wherein selected ones of said inclined beams have end portions in the regions of selected ones of said ends and the respective pairs of flanges of selected ones of said connecting members receive said end portions.

22. A support system as defined in claim 21, wherein each of said selected connecting members has a symmetry plane which is transverse to the respective flanges and spaced from the latter by a distance such that the neutral axes of the elongated beam and inclined beam received by each pair of flanges intersect in the symmetry plane of the respective selected connecting member.

23. A support system as defined in claim 21, wherein the respective pairs of flanges of said selected connecting members are provided with one set of mounting openings for the respective elongated beam and another set of mounting openings for the respective inclined beam.

24. A support system as defined in claim 23, wherein the sets of mounting openings in the respective pairs of flanges of said selected connecting members are arranged such that the elongated beams received by said selected connecting members are substantially horizontal.

25. A support system as defined in claim 23, wherein the sets of mounting openings in the respective pairs of flanges of said selected connecting members are arranged such that the elongated beams received by said selected connecting members are inclined to the horizontal at an acute angle corresponding to the calculated deflection under load.

26. A support system as defined in claim 19, wherein said connecting members have diametrically opposed pairs of spaced flanges which receive said ends.

27. A support system as defined in claim 19, wherein said connecting members have four pairs of spaced flanges which receive said ends.

28. A support system as defined in claim 19, wherein each of said flanges comprises a protuberance facing the respective end.

29. A support system as defined in claim 1, wherein said connecting members are cruciform.

30. A support system as defined in claim 1, wherein said connecting members are substantially symmetrical.

31. A support system as defined in claim 30, wherein each of said connecting members has a receiving opening with an axis on the symmetry line of the respective connecting member.

32. A support system as defined in claim 1, wherein said system is prefabricated.

33. A support system as defined in claim 1, wherein said material is malleable cast iron.

34. A support system as defined in claim 1, wherein said material is cast steel.

35. A support system as defined in claim 1, wherein said material is cast aluminum.

36. A support system for a structure such as a building, said system comprising:

(a) a plurality of substantially planar structural members under tensile and/or compressive load, each of said structural members including an elongated upper beam having a neutral axis, an elongated lower beam spaced from the respective upper beam and having a neutral axis, a plurality of inclined beams connecting the respective upper and lower beams and having respective neutral axes, and ribs on said elongated beams forming extensions of said inclined beams, and each of said structural members comprising at least one pair of neighboring inclined beams which converge in a direction towards a predetermined elongated beam of the respective structural member, the ribs which form extensions of neighboring converging inclined beams merging with one another substantially at the neutral axis of the respective predetermined elongated beam, and the widths of said elongated beams in longitudinal direction thereof varying substantially in relation to the longitudinal load distributing along the respective elongated beams, each of said structural members being constituted by a single casting of a ductile metallic material; and (b) connecting members releasably connecting said structural members with one another, each of selected ones of said connecting members being connected with a selected elongated beam and a corresponding selected inclined beam of a respective structural member, and each of said selected connecting members having a central plane extending transversely of the respective structural member, the neutral axis of a selected elongated beam intersecting the neutral axis of the corresponding selected inclined beam in the central plane of the respective selected connecting member, and each of said connecting members being constituted by a single casting of a ductile metallic substance.

37. A support system as defined in claim 36, wherein said material and said substance are cast iron with spheroidal graphite.

* * * * *